US007775651B2

(12) United States Patent
Joppen et al.

(10) Patent No.: US 7,775,651 B2
(45) Date of Patent: Aug. 17, 2010

(54) INK JET DEVICE WITH A VENTILATION CONDUIT

(75) Inventors: Sandor H. G. Joppen, Venlo (NL); Peter J. Hollands, Baarlo (NL)

(73) Assignee: OCÉ-Technologies B.V., Venlo (NL)

( * ) Notice: Subject to any disclaimer, the term of this patent is extended or adjusted under 35 U.S.C. 154(b) by 825 days.

(21) Appl. No.: 11/580,863

(22) Filed: Oct. 16, 2006

(65) Prior Publication Data

US 2007/0085886 A1 Apr. 19, 2007

(30) Foreign Application Priority Data

Oct. 17, 2005 (EP) ..... 05109633

(51) Int. Cl.
*B41J 2/175* (2006.01)

(52) U.S. Cl. ..... 347/88; 347/99

(58) Field of Classification Search ..... 347/88, 347/99, 103, 100, 95, 96, 84, 85, 86
See application file for complete search history.

(56) References Cited

U.S. PATENT DOCUMENTS 4,814,786 A 3/1989 Hoisington et al.
5,557,305 A 9/1996 Hine et al.

FOREIGN PATENT DOCUMENTS

EP 0 805 034 A2 2/1997
JP 01255548 10/1989

*Primary Examiner*—Manish S Shah
(74) *Attorney, Agent, or Firm*—Birch, Stewart, Kolasch & Birch LLP

(57) ABSTRACT

An ink jet device utilizing hot melt ink, said device including an ink reservoir, a heater arranged to heat ink contained in the ink reservoir, and a ventilation conduit which is connected to a ventilation opening in a top wall of the ink reservoir, said ventilation conduit containing a channel running upwards through a heated area. The ink jet device includes an ink melting unit for supplying melted ink to the ink reservoir, said ink melting unit being arranged to enable melted ink to flow into the ink reservoir from above, said channel of the ventilation conduit being in thermal contact with the ink melting unit.

14 Claims, 1 Drawing Sheet

INK JET DEVICE WITH A VENTILATION CONDUIT

This application claims priority under 35 U.S.C. §119(a) on Patent Application No. 05109633.7 filed in Europe on Oct. 17, 2005, the entire contents of which is hereby incorporated by reference.

BACKGROUND OF THE INVENTION

The present invention relates to an ink jet device comprising an ink reservoir for hot melt ink, a heater arranged to heat ink contained in the ink reservoir, and a ventilation conduit which is connected at a lower end thereof to a ventilation opening in a top wall of the ink reservoir, said ventilation conduit comprising a channel, the maximum diameter of which is smaller than the length of the channel. For example, the channel consists of a tube.

Ink jet printers operating with hot melt ink, i.e., with ink that is solid at room temperature, comprise an ink reservoir which can be heated in order to maintain the ink in the liquid state in which it can be supplied to the printhead. To prevent ink from leaking through a printing nozzle of the printhead, it has been proposed to apply a suction to a space of the ink reservoir through a ventilation conduit. For example, a negative pressure of approximately 1 kPa (10 mbar) is maintained within the space of the ink reservoir. However, when the ventilation opening of the ink reservoir is splattered with ink, ink may enter the ventilation conduit and may solidify inside the ventilation conduit, thus clogging the ventilation conduit. Under these conditions, the negative pressure can no longer be maintained in the space of the ink reservoir. The ventilation conduit might also be clogged in a similar manner if the ink reservoir is overfilled with melted ink.

SUMMARY OF THE INVENTION

It is an object of the present invention to provide an ink jet device with an ink reservoir for melted hot melt ink which is provided with a more reliable ventilation system.

According to the present invention, this object is achieved by an ink jet device of the kind mentioned above wherein a channel runs upwards through a heated area. The channel is heated by the heated area to a temperature that is above a melting point of the ink. Thereby, any ink entering the ventilation conduit from the ink reservoir will be maintained in the melted state and will flow downwards back into the ink reservoir. Thus, clogging of the ventilation conduit is prevented. The smaller the diameter of the channel, the higher the ink might rise within the channel. Therefore, the invention is especially advantageous when the maximum diameter of the channel is smaller than half the length of the channel, and even more advantageous when the maximum diameter of the channel is smaller than one quarter of the length of the channel.

In one embodiment, the channel is, through a ventilation opening, permanently opened to the ink reservoir. In this case, no closure is provided at the ventilation opening which could prevent ink from entering the ventilation conduit. Therefore, the invention is particularly useful. However, the ventilation conduit may also have a non-return valve that closes in the case of a high enough pressure within the ink reservoir.

Preferably, the height of said channel at least corresponds to a capillary rise that melted ink filling the lower end of the ventilation conduit would experience. The capillary rise depends on the wetting properties of the channel walls and on the geometry of the channel. By adapting the height of the channel to the possible capillary rise, the optimum height of the channel in view of the necessary space and the desired clogging prevention effect is determined.

In the case where the ink jet device includes means for applying at least one of a negative pressure and a positive pressure through at least one of said ventilation conduit and a second conduit to a space of the ink reservoir, the height of said channel preferably at least corresponds to a rise that melted ink filling the lower end of the ventilation conduit would experience due to possible capillary forces and also said at least one of a negative pressure and a positive pressure. For example, in the case of the ink jet device comprising at least one printing nozzle and means for applying a negative pressure to a space of the ink reservoir through said ventilation conduit for preventing melted ink from leaking through the printing nozzle, the height of said channel preferably at least corresponds to the rise that melted ink filling the lower end of the ventilation conduit would experience due to the negative pressure and possible capillary forces. Therefore, although the negative pressure is applied by a suction through the ventilation conduit, melted ink filling the lower end of the ventilation conduit will not rise beyond the heated area of the channel.

In a preferred embodiment, at least a section of the ventilation conduit consists of a tube forming said channel and being open to the ventilation opening of the ink reservoir at the lower end of the ventilation conduit, said ventilation opening being arranged above a nominal fill level of the ink reservoir, the ventilation conduit extending substantially upright from said ventilation opening through said heated area.

According to a further development of the present invention, the ink jet device comprises an ink melting unit for supplying melted ink to the ink reservoir, said ink melting unit being arranged to enable melted ink to flow into the ink reservoir from above, said channel of the ventilation conduit being in thermal contact with the ink melting unit. For example, the ventilation conduit runs along or through the ink melting unit and is heated by the ink melting unit. Thus, the heat supplied by the ink melting unit is utilized for heating the channel of the ventilation conduit. This is advantageous, because the heated area through which the channel runs and the ink melting unit both have to be maintained at a temperature where the ink melts. Moreover, during a sleep mode of a printer, for example, it will be less probable that ink enters into the ventilation conduit, so that the ventilation conduit may be allowed to cool down together with the ink melt unit.

In one embodiment, the ink melting unit comprises a separate heater. That is, the heater is separate from the heater arranged to heat ink contained in the ink reservoir. Thus, the heating of the ink reservoir and of the ink melting unit is more efficient than it would be in the case of an integrated structure with only one heater for the ink reservoir and the ink melting unit. This is because there is more energy required to melt the ink in the ink melting unit than to maintain the melted ink in a melted state in the ink reservoir.

In another embodiment, the ventilation conduit is not guided through the melting unit but is separated therefrom such that no thermal contact exist between the ventilation conduit and the melting unit. In the latter case a separate heater may be provided to heat at least the lower part of the ventilation conduit which communicates with the ink reservoir. The lower part of the ventilation conduit is the part which may be exposed to intrusion of the melted ink from the ink reservoir. This intrusion may originate from uncontrolled movement of the melted ink and/or from overfilling of the ink reservoir and/or from suction, and/or from capillary forces.

Separating the ventilation conduit from the melting unit creates a greater freedom in designing the print head.

In a preferred embodiment, a wall of the ink reservoir comprises an ink filter, the ink filter and the ink melting unit being arranged to enable melted ink to flow from the melting unit through the ink filter into the ink reservoir, the ventilation opening being arranged separately from the ink filter. By arranging the ventilation opening separately from the ink filter, the ink does not have to flow through the ventilation opening into the ink reservoir. Thus, a more reliable ventilation is achieved.

Preferably, a pressure sensor is arranged at the channel. The pressure sensor senses a pressure within the channel and can be utilized to monitor the negative pressure that is applied to the space of the ink reservoir. By arranging the pressure sensor at the channel, the sensor is at a position that is normally not filled with ink and, moreover, will be heated at least approximately to a determined temperature, thus enhancing the measuring accuracy.

BRIEF DESCRIPTION OF THE DRAWINGS

A preferred embodiment of the present invention will now be described in conjunction with the following drawing, wherein.

DETAILED DESCRIPTION OF THE INVENTION

Figure 1:
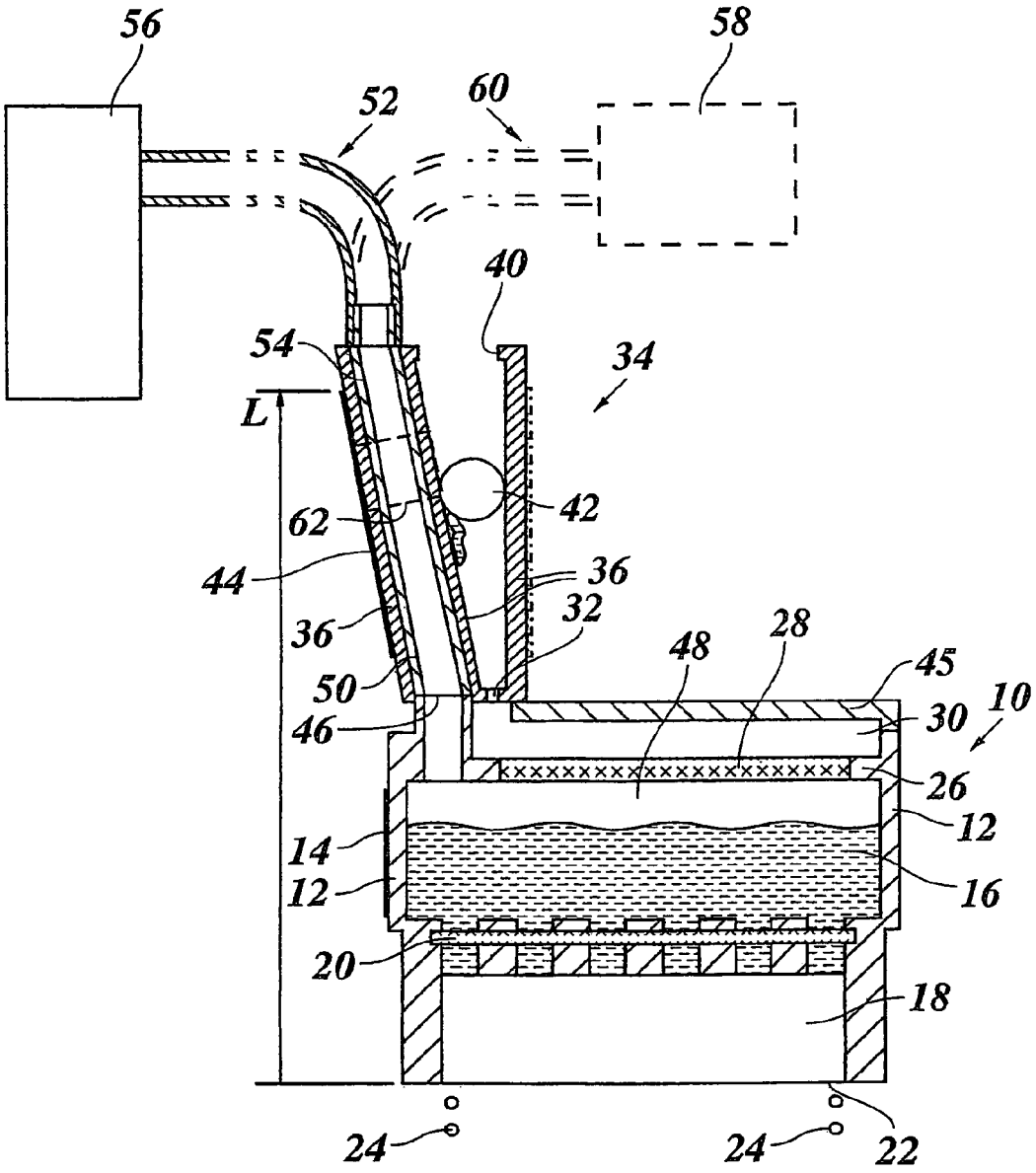
FIG. 1 shows a sectional view of an ink jet device with an ink reservoir and an ink melting unit.

The ink jet device comprises an ink reservoir 10 having walls 12 made of thermally conductive material. As is generally known in the art, an electric heater 14 is in contact with or integrated in the walls 12 of the ink reservoir so that hot melt ink 16 contained in the ink reservoir is maintained at a temperature of, for example, 120° C. and in any case at a temperature above its melting point, so that the ink is kept in a liquid state and is ready to be supplied to an ink jet printhead 18 which is arranged below the ink reservoir and which is in fluid connection with the ink reservoir 10 via a filter 20. The ink jet printhead 18 comprises printing nozzles 22, as generally known in the art. Some ink jets 24 are indicated as examples. As is also generally known in the art, the ink reservoir 10 and the printhead 18 may be mounted on a reciprocating carriage of a printer, so that the ink reservoir 10 is moved back and forth in the direction of the line of sight of the figure when the printer is operating.

A top wall 26 of a compartment of the ink reservoir 10 contains an ink filter 28. A flat chamber 30 above the ink filter 28 is sealedly connected to a lower exit opening 32 of an ink melting unit 34 which is arranged above the ink reservoir 10. Walls 36 of the ink melting unit 34 are made of a thermally conductive material and form a funnel. At the top of the ink melting unit 34, there is arranged an inlet opening 40 for globular ink pellets 42 which consist of solidified hot melt ink. Ink pellets 42 are supplied into the interior of the ink melting unit 34 on demand. An electric heater 44 is in contact with or integrated in the walls 36 of the ink melting unit 34 so that an ink pellet 42 that is present in the ink melting unit 34 is melted and flows through the exit opening 32 and further through the ink filter 28 into the ink reservoir 10.

The fill level of the ink reservoir 10 drops during printing and rises when a new ink pellet 42 is melted. Thus, the fill level of the ink reservoir 10 fluctuates around a nominal fill level which is below the ink filter 28 and thus below the wall 26.

At a top wall 45 of the ink reservoir 10, there is provided a ventilation opening 46 which is arranged separately from the ink filter 28. The ventilation opening 46 connects a space 48 of the ink reservoir 10 above the melted ink 16 with a tube 50 forming a section of a ventilation conduit 52. From the ventilation opening 46 at the lower end of the tube 50, the tube 50 runs substantially upright through the ink melting unit 34. In the area of the ink melting unit 34, the tube 50 forms a channel 54 which is integrated in or is in contact with the walls 36 of the ink melting unit 34 over the whole height of the ink melting unit 34. For example, the channel is integrated in a wall near the heater 44. Thereby, the channel 54 is heated by the ink melting unit 34 to a temperature at which the ink is liquid. Alternatively, the channel 54 may run through the ink melting unit 34 at a distance from the walls 36, thus being heated by the surrounding walls 36 and/or the melted ink. The maximum diameter of the channel 54 is, for example, smaller than 1/10 of the length of the channel 54.

Through the ventilation conduit 52, a suction is applied to the ink reservoir 10 by a suitable suction device 56, thus maintaining a negative pressure of, for example, approximately 1 kPa (10 mbar) within the space 48 of the ink reservoir 10. The suction device 56 may be implemented as known in the art.

If ink enters the ventilation conduit 52 at the ventilation opening 46 due to uncontrolled movement of the melted ink 16 or due to overfilling of ink reservoir 10, this ink might be drawn up the tube 50 due to the suction, and, possibly also due to capillary forces depending on the wetting properties of the walls of the tube 50 and the geometry of the tube. A maximum rise level L may be, for example, approximately 90 mm above the printing nozzles 22. In the described example, the channel 54 therefore extends to a height that is above the maximum rise level L. Thereby, ink entering into the ventilation conduit 52 will stay liquid, so that a clogging of the ventilation conduit 52 due to solidification of the ink is prevented.

In a modified embodiment, a pressure device 58 is connected to the space 48 of the ink reservoir 10 via a second conduit 60 and a second ventilation opening of the ink reservoir 10. The second conduit 60 is configured similar to the ventilation conduit 52 with a tube forming a section of the ventilation conduit, said tube forming a second channel running through the ink melting unit 34 in parallel with the channel 54 and being in thermal contact with the ink melting unit 34. In FIG. 1, the second channel lies behind the channel 54.

The pressure device 58 is adapted to apply a pressure to the ink reservoir 10 for purging the printing nozzles 22. While the pressure is applied, the ventilation conduit 52 is closed at the suction device 56. However, ink entering the ventilation conduit 52 may be driven up the channel 54 due to the build-up of the pressure. Therefore, the height of the channel 54 is adapted to a maximum rise level L resulting from the pressure and possible capillary forces. The second channel of the second conduit 60 has the same height. Thus, ink entering into the ventilation conduit 52 or into the second conduit 60 will stay liquid, so that a clogging of the ventilation conduit 52 and the second conduit 60 due to solidification of the ink is prevented.

At the channel 54, there is arranged a pressure sensor 62 for sensing the pressure within the channel 54. The pressure sensor 62 is indicated with dashed lines.

In a modified embodiment only the pressure device 58 may be connected to the ink reservoir via a ventilation conduit as described above, while the suction device 56 may be connected to the ink reservoir 10 in a different manner as known in the art. For example, a non-return valve may be used. Alternatively, the pressure device may be connected via a non-return valve.

The embodiments as described above are only examples of an ink jet device according to the present invention and may be varied as is known in the art. For example, the heater 44 of the ink melting unit 34 may also be arranged at a position indicated by chain dotted lines at the right side of the ink melting unit 34 in the figure instead of being arranged at the wall near the channel 54. Moreover, the pressure device 58 may be connected to the same ventilation conduit 52 as the suction device 56 or may be integrated in the suction device 56.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An ink jet device, comprising an ink reservoir for hot melt ink, a heater arranged to heat ink contained in the ink reservoir, a ventilation conduit which is connected at a lower end thereof to a ventilation opening in a top wall of the ink reservoir, said ventilation conduit comprising a channel a maximum diameter of which is smaller than a length of the channel, wherein said channel runs upwards through a heated area, and means for applying at least one of a negative pressure and a positive pressure through at least one of said ventilation conduit and a second conduit to a space of the ink reservoir, wherein the height of said channel at least corresponds to a rise that melted ink filling the lower end of the ventilation conduit would experience due to possible capillary forces and said at least one of a negative pressure and a positive pressure.

2. The ink jet device according to claim 1, wherein the channel is, through communication with the ventilation opening, permanently open to the ink reservoir.

3. The ink jet device according to claim 1, wherein at least a section of the ventilation conduit consists of a tube forming said channel and being open to the ventilation opening of the ink reservoir at the lower end of the ventilation conduit, said ventilation opening being arranged above a nominal fill level of the ink reservoir, the ventilation conduit extending substantially upright from said ventilation opening through said heated area.

4. The ink jet device according to claim 1, wherein the heated area of the ink jet device comprises an ink melting unit for supplying melted ink to the ink reservoir, said ink melting unit being arranged to enable melted ink to flow into the ink reservoir from above, said channel of the ventilation conduit being in thermal contact with the ink melting unit.

5. The ink jet device according to claim 4, wherein the ink melting unit comprises a separate heater.

6. The ink jet device according to claim 4, wherein a wall of the ink reservoir comprises an ink filter, the ink filter and the ink melting unit being arranged to enable melted ink to flow from the ink melting unit through the ink filter into the ink reservoir, the ventilation opening communicating with the ink reservoir separately from the ink filter.

7. The ink jet device according to claim 1, further comprising a pressure sensor being arranged at the channel.

8. The ink jet device of claim 1 wherein the second conduit is in thermal contact with the ink melting unit.

9. The ink jet device of claim 1, wherein the length of the channel is larger than four times the maximum diameter of the channel.

10. An ink jet device which comprises:

an ink reservoir, an ink melting unit communicating with the ink reservoir for supplying melted ink into the ink reservoir, a ventilation conduit passing through the ink melting unit and separately communicating with the ink reservoir, heating means operatively associated with the ink melting unit for applying heat to the ink melting unit and the ventilation conduit passing therethrough, and means for applying at least one of a negative pressure and a positive pressure through at least one of said ventilation conduit and a second conduit to a space of the ink reservoir, wherein the height of said channel at least corresponds to a rise that melted ink filling the lower end of the ventilation conduit would experience due to possible capillary forces and said at least one of a negative pressure and a positive pressure.

11. The ink jet device of claim 10 wherein a suction device is connected to the ventilation conduct.

12. The ink jet device of claim 10 wherein a channel through the ventilation conduct is permanently opened.

13. The ink jet device of claim 10, wherein a channel through the ventilation conduit is provided with a non-return valve.

14. The ink jet device of claim 10, wherein a separate pressure conduit passes through the ink melting unit and separately communicates with the ink reservoir, said pressure conduit being provided with a pressure device for applying the pressure to the ink reservoir.

* * * * *